United States Patent [19]

Watson

[11] 4,235,288

[45] Nov. 25, 1980

[54] WELL PUMPING CONTROL SYSTEM

[75] Inventor: Willie L. Watson, Fredericksburg, Ohio

[73] Assignee: Multi-Products Co., Millersburg, Ohio

[21] Appl. No.: 944,889

[22] Filed: Sep. 22, 1978

[51] Int. Cl.[3] ..... E21B 29/02

[52] U.S. Cl. ..... 166/64; 166/53; 137/624.11

[58] Field of Search ..... 166/64, 53; 137/624.11, 137/455; 251/20, 21, 31, 41, 48, 78

[56] References Cited

U.S. PATENT DOCUMENTS

| | | | |
|---|---|---|---|
| 2,263,565 | 11/1941 | Boynton | 166/53 |
| 2,532,153 | 11/1950 | Drescher et al. | 251/31 |
| 2,550,093 | 4/1951 | Smith | 166/64 X |
| 2,664,755 | 1/1954 | Kiel | 137/624.11 X |
| 3,266,574 | 8/1966 | Gandy | 166/53 |
| 3,863,714 | 2/1975 | Watson | 166/53 |

*Primary Examiner*—James A. Leppink
*Assistant Examiner*—Richard E. Favreau
*Attorney, Agent, or Firm*—Frease & Bishop

[57] ABSTRACT

A system for automatically opening and closing a valve located in a fluid delivery line of a gas well for starting and stopping the pumping action of the well when the pressure in the well is sufficient to enable gas and oil to be pumped therefrom. A pivotally mounted beam is engaged at opposite ends by a pair of pistons which are operatively connected to and actuated by the pressure in the well casing and in the well delivery tube, respectively. One end of the beam operates a first valve which is located in a pressure line communicating with the delivery line control valve for opening and closing the control valve. The beam opens the first valve when the pressure differential between the well casing and delivery tube reaches a preset, predetermined amount through the action of the pistons on the beam. Opening of the first valve also operates a third piston which sets a mechanical timer for a predetermined time period. A timer stop link is pivotally mounted on the first valve and is actuated by the beam upon moving the first valve to open position to disengage the link from the timer. A second valve deactuates the second piston immediately after the well pumping action has started to enable the timer to begin movement through its timing period, during which period the first valve and delivery tube control valve are open. The stop link engages a notch formed in a camming plate of the timer upon completion of the timing cycle. Movement of the stop link into the camming plate notch simultaneously closes the first valve, which in turn closes the delivery tube control valve and stops the well pumping action.

28 Claims, 9 Drawing Figures

WELL PUMPING CONTROL SYSTEM

BACKGROUND OF THE INVENTION

1. Field of the Invention

The invention relates to gas wells, and in particular, to a system and related components for automatically starting and stopping the pumping action of a well. More particularly, the invention relates to a well control system which starts the pumping action of a well when the pressures within the well casing and delivery tube reach a predetermined pressure differential, and which maintains this pumping condition for a predetermined and controlled time period.

2. Description of the Prior Art

Many gas wells do not operate continuously, but operate on an "on-off" pumping cycle based upon the availability of the fluids or gas flowing into the bottom of the well casing. This situation especially exists in low volume gas wells where the gas which is pumped from the well takes time to accumulate to suffient amounts and pressure for removal. It is most efficient to pump this gas from the well only when this predetermined amount has accumulated in the well, which in many wells does not occur on a regular timing cycle or basis.

Many of these low volume gas wells are operated by a preset timer which is adjusted according to the particular pumping or production experience for that well. The timer is set to turn the well on and to keep the well on a particular number of times throughout the day. The terms "pumping" or "well on" conditions means that a control valve in the well delivery pipe is open, which enables the gas pressure developed within the well to automatically pump or force the collected fluids at the bottom of the well up through the delivery tube and into the delivery pipe without requiring any electrical, mechanical or similar pumping means.

There are problems with such timer-controlled wells in that the volume of gas and its associated pressure may not have accumulated sufficiently for proper operation when the timer turns the well on. At other times the pumping or "on" cycle may be too long or too short for the volume of accumulated gas or other fluids causing the well to "drown out". Any of these situations may require the well to be shut down and "blown out", all of which takes an operator's time, and consequently, increases operating costs with lower production.

Other well control systems, in order to eliminate the problems incurred with preset timer controls, operate off the well pressure to start a predetermined timing cycle. This pressure may be measured directly from the well casing or delivery tube, or a combination thereof. In most of these types of control systems the well may be turned on and off by the casing pressure. Problems can occur with such systems in that the casing pressure may not drop low enough in certain situations to shut the well off, even though all of the fluid has been taken out of the well through the delivery tube. Also, many of these type systems use various components which are subject to continuous maintenance and upkeep.

Therefore, the need has existed for a pumping control system which actuates the well pumping on and off cycles in relationship to the pressure differential existing between the well casing and tubing, and in which a predetermined "well on" time period may be incorporated into the pumping cycle to insure that the well will remain on for only a predetermined, preset time period.

SUMMARY OF THE INVENTION

Objectives of the invention include providing a system for automatically operating a gas well pumping cycle in which the well is turned on when the pressure differential between the well casing and well delivery tube reaches a predetermined amount, irrespective of the actual amount of pressure in either the casing or delivery tube; providing such a system in which a timing mechanism maintains the well in an on condition for a predetermined, preset time period after actuation, regardless of the pressures in either the well casing or delivery tube once the timing cycle has started, and in which the control mechanism automatically turns the well off after passage of this time period and resets the mechanism for reactuation to a pumping condition as soon as this pressure differential is again reached; providing such a control system in which the timing mechanism may be eliminated and the pumping cycle controlled entirely by the pressure differential for both starting and stopping the well pumping operation based upon the well casing and delivery tube pressure differential; providing such a system in which the actuating pressure differential can be adjusted easily by manual manipulation of a setscrew to achieve different operating characteristics, and in which the pumping on timing cycle can also be adjusted by manual setting of a mechanical timer used for controlling the same; providing such a control system in which a pair of pistons, which are operatively connected to and controlled by the casing and tube pressures, do not require the use of any spring return mechanism for operation thereof to reduce maintenance and wear problems; providing such a system which uses relatively inexpensive and simple components for achieving the desired well control, which components can be mounted and incorporated into an existing well control system without expensive or elaborate modifications being required, and in which usual control valves and pistons are used to achieve the basic advantages; and providing such a system which eliminates difficulties encountered with prior well control systems, which achieves the stated objectives simply, effectively and inexpensively, and which solves problems and satisfies existing needs.

These objects and advantages are obtained by the improved system for automatically operating a fluid delivery control valve in a gas well thereby regulating the "on-off" time of the well, the general nature of which may be stated as including beam means pivotally mounted for movement between actuating and deactuating positions; first piston means operatively engageable with the beam means for moving said beam means between the actuating and deactuating positions, said first piston means being operatively connected to the well and operated by and in relationship to pressures developed within the well; first valve means movable between open and closed positions by the beam means, the first valve means being adapted to be operatively connected to the fluid delivery control valve for operating said control valve in response to operation of said first valve means by the beam means; timer means; link means operatively engageable with the timer means, with the first valve means, and with the beam means, said link means being actuated by the beam means for controlling said timer means; second piston means operatively engageable with the timer means and actuating the timer means when the beam means moves from deactuating to actuating positions; and the link means deactuating the timer means and permitting the first valve means to move to closed position after a predetermined time period, whereupon the fluid delivery control valve is deactuated by the first valve means upon closing of the first valve means to stop the flow of fluid from the well.

BRIEF DESCRIPTION OF THE DRAWINGS

Preferred embodiments of the invention—illustrative of the best modes in which applicant has contemplated applying the principles—are set forth in the following description and shown in the drawings and are particularly and distinctly pointed out and set forth in the appended claims.

Similar numerals refer to similar parts throughout the drawings.

DESCRIPTION OF THE PREFERRED EMBODIMENTS

First Embodiment

Figure 1:
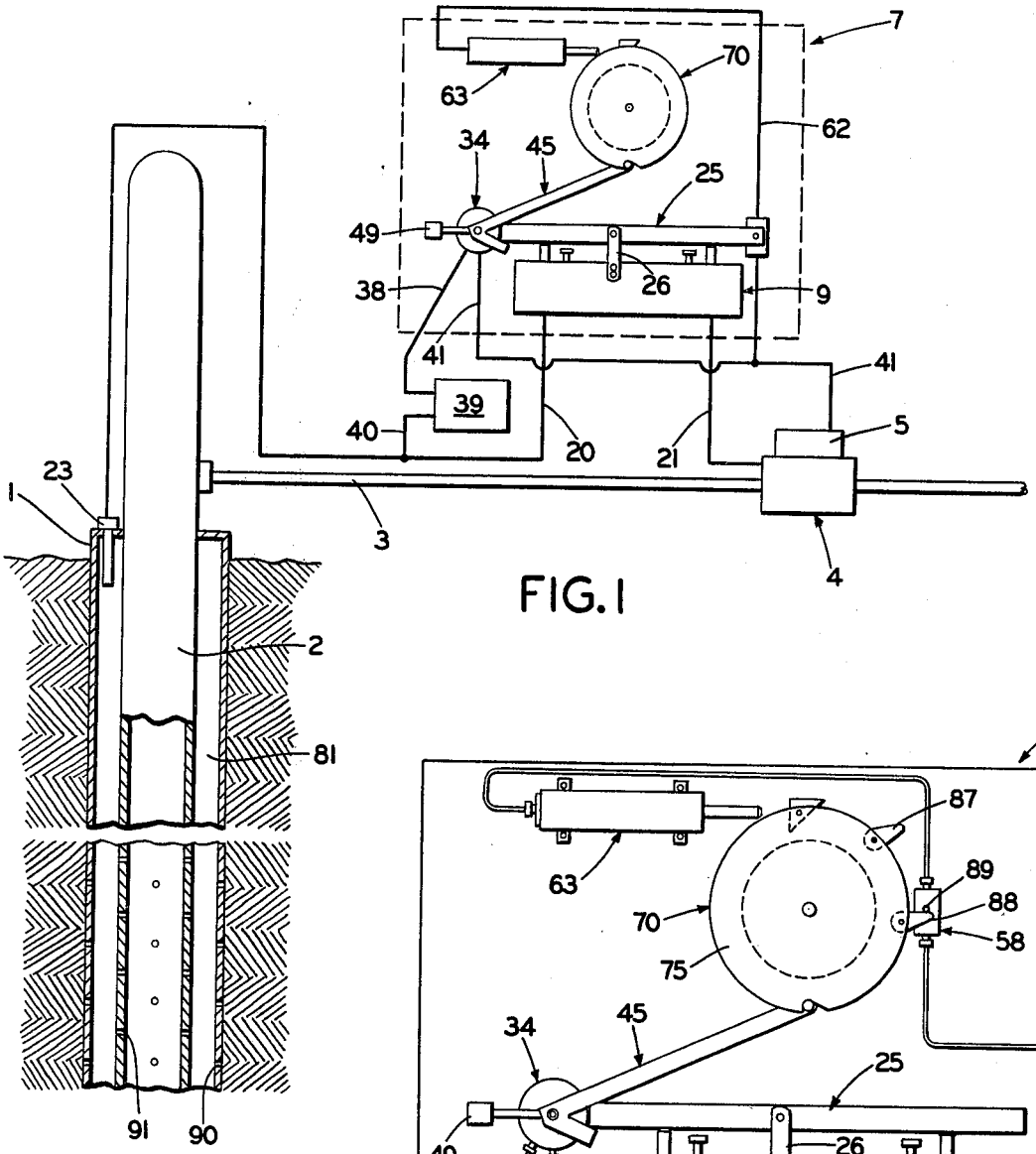
FIG. 1 is a fragmentary generally diagrammatic view, portions of which are in section, showing the improved pumping control system connected to a gas well.

FIG. 1 illustrates diagrammatically a portion of a gas well of the type in which the improved operating system for starting and stopping the pumping action of the well is used. A usual gas well arrangement includes an outer casing 1 which extends into the ground, having an inner fluid delivery tube 2 located therein and extending outwardly from the top of casing 1. An outlet or delivery pipe 3 communicates with delivery tube 2 and allows the flow of gas, oil and other fluids from tubing 2 to a suitable processing and storage tank (not shown) where oil and other liquids are separated from the gas.

A control valve 4 is mounted in outlet pipe 3 and preferably is controlled by a pressure-operated control mechanism 5 for selectively opening and closing valve 4 to permit the flow of the gas and liquids from tube 2 through outlet pipe 3.

The improved control mechanism is indicated generally at 7, and preferably is located closely adjacent to the well. Control mechanism 7 is shown particularly in FIG. 2 mounted on a support or backing board 8 in a somewhat diagrammatic fashion.

In accordance with the invention, a piston block 9 is formed with a pair of spaced, vertically extending piston chambers 10 and 11. Pistons 12 and 13 are slidably mounted within chambers 10 and 11, respectively, with their respective piston rods 14 and 15 extending outwardly through complementary-shaped openings 16 and 17 formed in the top of block 9 and communicating with piston chamber 10 and 11. A pair of O-rings 18 are mounted on each piston 12 and 13 to seal the piston with respect to the chamber walls.

Gas lines 20 and 21 are connected to the bottoms of chambers 10 and 11, respectively, by connectors 22. Gas line 20 is connected to the interior of well casing 1 (FIG. 1) through a connector 23, whereby the pressure developed within casing 1 is applied to piston 12 for vertically moving the piston upwardly within its chamber 10. Gas line 21 is connected to outlet pipe control valve 4 or directly to outlet pipe 3, whereby the pressure developed within delivery tube 2 is applied to piston 13 for vertically moving the piston upwardly within its chamber 11.

A horizontal beam 25 is pivotally mounted on piston block 9 by an upstanding bracket 26, which is attached by bolts 27 to block 9. Beam 25 is pivotally mounted on the upper end of bracket 26 by a pin 28 which is located intermediate beam ends 29 and 30. Pivot pin 28 divides the beam into a pair of moment arms, which in turn are adapted to be engaged by piston rods 14 and 15, respectively. Preferably, the moment arm formed by beam end 30 is longer with respect to its actuating piston rod 15 than is the moment arm of beam 29 formed between pivot pin 28 and piston rod 14. A pair of stop bolts 32 is mounted on the upper surface of piston block 9 between the respective piston rods 14-15 and pivot bracket 26 to limit the extent of downward pivotal movement of beam 25 in either direction.

A first valve 34 is mounted adjacent the outer edge 35 of beam end 29. Valve 34 is a usual on-off valve having an actuating stem 36. The rotation of stem 36 moves the internal valve mechanism between valve open and closed positions. If desired, valve 34 may be of the three-way valve type in which a third opening or escape port is provided in addition to the fluid incoming and outgoing ports. An incoming gas line 38 extends between valve 34 and a usual pressure regulator 39. Regulator 39 in turn is connected to pressure line 20 by a connecting line 40 and to the interior of well casing 1. Pressure regulator 39 merely is used to maintain a constant output pressure in line 38 for controlling the operation of control valve 4, regardless of the amount of pressure developed within casing 1. Valve 34 is connected to control valve 4 by an outlet line 41.

A timer control link, indicated generally at 45, is mounted on valve stem 36 and is intended to rotate stem 36 to move the internal valve mechanism between open and closed positions. Link 45 includes a first lever arm 46 and a second lever arm 47, which join together at junction 48, at which location valve stem 36 is attached. A counter weight 49 is attached to link junction 48 and extends outwardly therefrom, the purpose of which is discussed below.

A pivot beam adjusting mechanism, indicated generally at 50, is mounted on board 8 by a pair of screws 51 adjacent beam end 30, preferably positioned vertically above piston rod 15. Adjusting mechanism 50 includes a bracket 52 having a thumbscrew 53, which regulates the tension on a coil spring 54 which is compressed between thumbscrew 53 and beam end 30. The lower end of spring 54 preferably is seated within a circular recess 55 formed in beam end 30.

A second valve 58 is mounted adjacent beam 25 and includes a control stem 59 which extends through a slot 60 formed adjacent the outer edge of beam end 30. Valve 58 is a usual on-off type valve for controlling the flow of a gas or other fluid. An incoming gas line 61 extends between and is connected to valve 58 and to outlet line 41 of valve 34 by a T-connector 33. Thus, gas enters valve 58 when valve 34 is in open position. An outlet line 62 extends between valve 58 and a third pressure-operated piston assembly 63.

Piston assembly 63 is of a usual construction consisting of a housing 64 having an interior chamber 65 which communicates with gas line 62 for moving a piston 66 slidably mounted therein, with piston rod 67 moving reciprocally through an opening 68 formed in the ends of housing 64. A spring 69 biases piston 66 and rod 67 toward the retracted, unactuated position of FIG. 2.

A mechanical timer mechanism, indicated generally at 70, is mounted on board 8 and is adapted to be operatively engaged by timer control link 45 and piston assembly 63. Timer mechanism 70 may be of the type shown in U.S. Pat. Nos. 2,543,032 and 2,583,245, or other similar type constructions. Manual rotation of a timer component winds a main spring or biases a similar mechanism which, upon releasing of the winding force, will unwind or rotate in the opposite direction. A predetermined time period will be required to "unwind" the clock, the amount of which depends upon the initial distance of rotation. This "unwind" time will then provide a predetermined timing or pumping period.

Broadly, timer mechanism 70 includes a mechanical timer 71 having a winding stem or arbor 72 which when rotated sets the timer as described in the above-mentioned patents. Other types of timing mechanisms can be used without departing from the concept of the invention.

Figure 3:
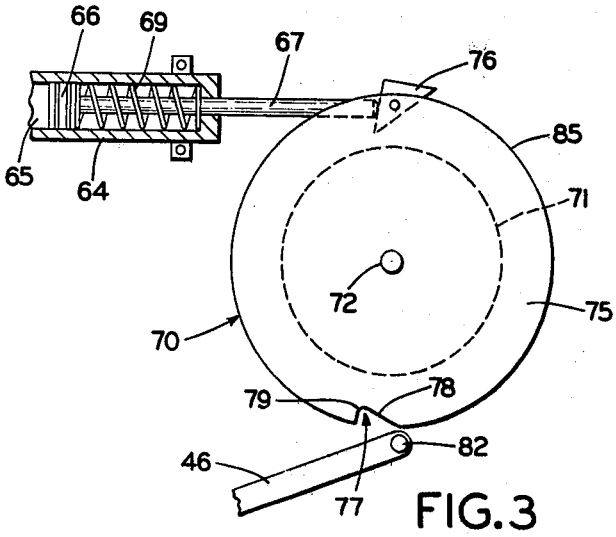
FIG. 3 is a fragmentary view with portions broken away and in section, showing beginning actuations of the timer mechanism.
Figure 4:
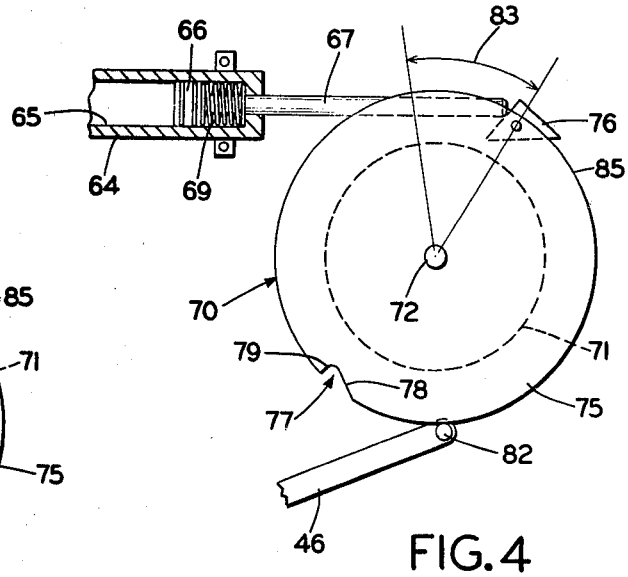
FIG. 4 is a view similar to FIG. 3 showing complete actuation of the timer mechanism.

In accordance with one of the features of the invention, a circular camming plate 75 is mounted on stem 72 of timer mechanism 71, whereby plate 75 and stem 72 in unison. A lug 76 is mounted on camming plate 75 adjacent the peripheral edge 85, with a notch 77 being formed in edge 85 generally diagonally opposite of lug 76 (FIGS. 3 and 4). Notch 77 has an inwardly extending ramp surface 78 and a radially extending shoulder surface 79.

The operation of the automatic well pumping control system and components thereof is described below, with reference particularly to FIGS. 1–4. FIG. 1 illustrates the above-described components, assemblies and mechanisms in an at-rest, or in a delivery pipe control valve closed position, that is, the well is in a nonpumping state. After a prior pumping operation has ended, pressure will gradually build up and increase within the annular space 81 surrounding delivery tube 2 within well casing 1, as well as an increase in pressure within delivery tube 2. Casing 1 and tubing 2 are formed with a plurality of perforations 90 and 91, respectively, adjacent the bottom of the well to permit the flow of gas, oil, water, etc. into the casing for delivery through tube 2 which also enables the pressure buildup. As the casing and tube pressures increase, correspondingly will the pressures increase on pistons 12 and 13 within piston chambers 10 and 11. Correspondingly, these pressures will be exerted by piston rods 14 and 15 on beam ends 29 and 30, respectively.

In accordance with the invention, beam 25 is designed and assembled whereby when a predetermined difference in pressure exists between the casing and tube pressures, for example 50 lbs., 100 lbs., etc., piston 13 will exert a sufficient upward force on beam end 30 to overcome the forces exerted by piston 12 on beam end 29 and by spring 54 if used. These resulting forces will pivot beam 25 in a counterclockwise direction about pivot pin 28. Even though the casing pressure applied to piston 12 will always be equal to or greater than the tube pressure applied to piston 13, the pivot pin and piston arrangement can be designed by increasing the size of piston 13 and the length of moment arm of lever end 30 with respect to pivot pin 28 or modifications thereof to enable beam 25 to pivot counterclockwise upon the preselected difference in pressure being reached.

The downward pivotal movement of lever end edge 35 engages and rotates lever arm 47 of control link 45. The rotation of link 45 in turn rotates valve stem 36 moving valve 34 from a closed to open position. Simultaneously with the opening of valve 34, a stop pin 82 which is mounted on the outer end of lever arm 46 moves outwardly from engagement within camming plate notch 77 to the postion of FIG. 3. This counterclockwise pivotal movement of beam 25 also actuates valve 58 due to the engagement of valve stem 59 in beam slot 60.

Figure 2:
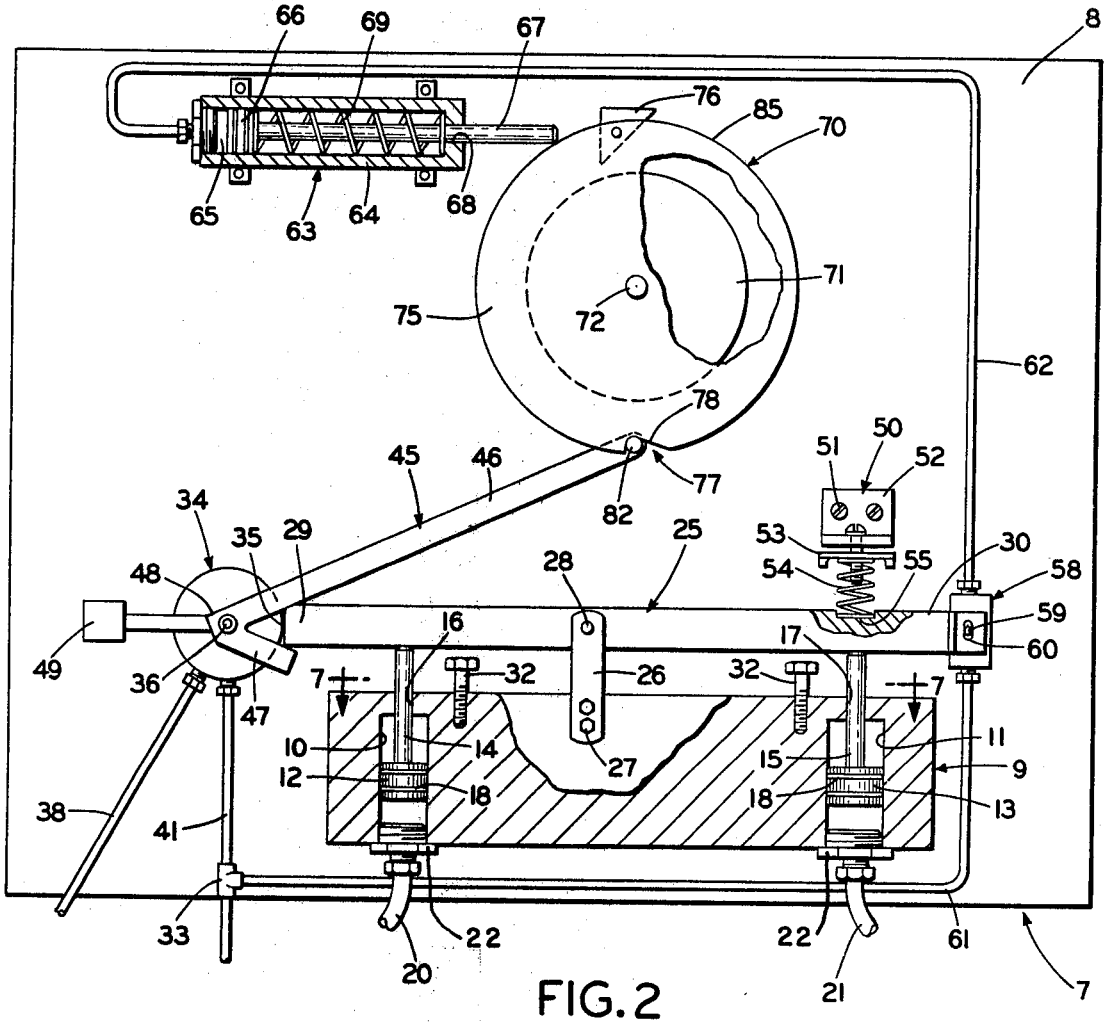
FIG. 2 is an enlarged fragmentary view of the control system of FIG. 1 with portions broken away and in section.

The gas in line 38 immediately flows through open valve 34 and into line 41 with the accompanying gas pressure operating control valve 4 to start a pumping operation, whereby the fluids at the bottom of the well automatically flow through tube 2 and into delivery pipe 3. Gas also will flow through line 61, valve 58, line 62, and into piston chamber 65 to actuate piston 66. Actuation of piston 66 moves piston rod 67 outwardly from housing 64 and into engagement with camming plate lug 76 (FIGS. 2 and 3). Piston 66 is moved a complete stroke to the forward end of housing 64 by the pressure of the gas exerted thereon. Piston rod 67 will rotate camming plate 75 and connected timer plate 71 in a clockwise direction a predetermined distance or degrees represented by 83, due to the abutting engagement of rod 67 with lug 76.

Almost immediately after the pumping action starts within the well, the pressure differential will increase between casing 1 and delivery tube 2, causing piston 12 to pivot beam 25 in a clockwise direction. This clockwise movement of beam 25 will close valve 58, whereupon spring 69 of piston assembly 63 retracts piston 66 and rod 67 from its forward timing plate engagement position of FIG. 4 to its retracted position of FIG. 1. Link assembly 45 will attempt to pivot in a counterclockwise direction and close valve 34 upon the return of beam 25 to its previous at-rest position, due to the force exerted on link 45 by counterweight 49. However, stop pin 82 engages peripheral edge 85 of camming plate 75, as shown in FIG. 4, maintaining valve 34 in an open position.

The clockwise rotational movement of camming plate 75 and stem 72 of timer mechanism 71 tensions or biases the internal timing spring, which in turn biases plate 75 to rotate in a counterclockwise direction. This counterclockwise rotational movement of plate 75 throughout distance 83 will require a predetermined amount of time, which is adjustable depending upon the particular timing mechanism used. This time period may be set for several minutes or several hours if desired. During the time period required for movement of plate 75 from the position of FIG. 4 to that of FIG. 2, valve 34 will remain open. Since valve 34 is open, the gas pressure output of regulator 39 is applied to control mechanism 5 to maintain control valve 4 in an open position. This in turn continues the pumping action of the well and delivery of the well fluids through delivery tube 2 and pipe 3.

After passage of the predetermined open valve well pumping time period, that is, the time required for camming plate 75 to rotate in a counterclockwise direction through distance 83, stop pin 82 will move along ramps 78 of camming plate 75, into notch 77 and against stop shoulder 79. Link 45 then will pivot sufficiently in a counterclockwise direction to close valve 34, whereupon the components reassume the at-rest nonpumping position of FIG. 2. This cycle is repeated each time the predetermined pressure difference between the well casing and delivery tube is reached. Pressure regulator mechanism 50 enables this actuating pressure differential to be adjusted easily by rotation of thumbscrew 53 changing the amount of pressure applied by spring 54 on beam end 30.

Second Embodiment

Figure 5:
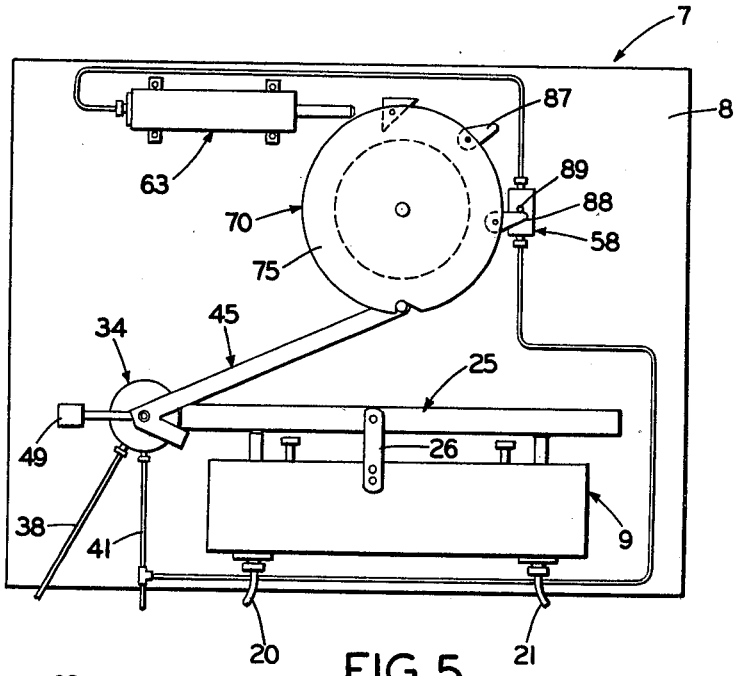
FIG. 5 is a fragmentary diagrammatic view of a modified well pumping control system.
Figure 6:
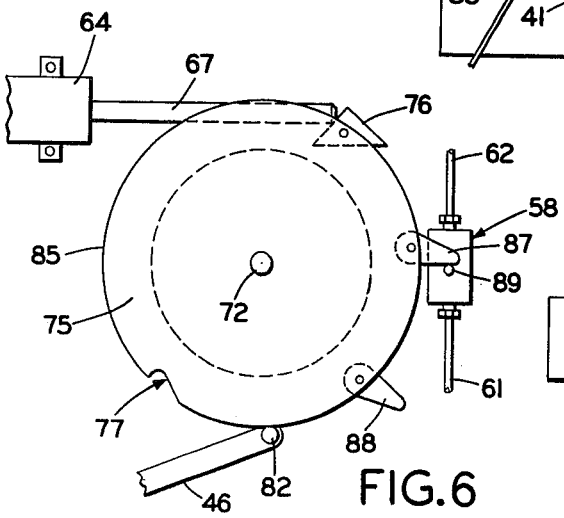
FIG. 6 is a fragmentary view of a modified timer mechanism of the modified control system of FIG. 5.
Figure 7:
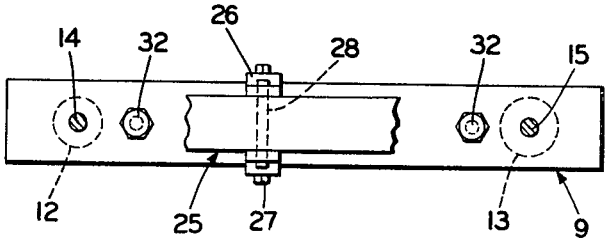
FIG. 7 is a fragmentary sectional view taken on line 7—7, FIG. 2.

A modified form of the invention is shown in FIGS. 5 and 6 in which the timer piston control valve 58 is relocated from its position at beam end 30 to a position adjacent timer camming plate 75. Camming plate 75 has a pair of lugs 87 and 88 mounted thereon adjacent peripheral edge 85. Lugs 87 and 88 are spaced circumferentially with respect to each other and from lug 76. The remaining components of the control system are the same as those described above with respect to control system 7.

When the system of FIGS. 5 and 6 is in a nonpumping condition, that is, with outlet pipe control valve 4 in a closed position, camming plate 75 will assume the position of FIG. 5. Lug 88 engages stem 89 of the timer piston control valve 58, placing the valve in open position. Immediately upon opening of valve 34, the gas pressure actuates piston assembly 63, rotating plate 75 in a clockwise direction to the position of FIG. 6, whereupon lug 87 engages valve stem 89, moving the valve to a closed position. Immediately upon valve 58 assuming a closed position, piston rod 67 is retracted by spring 69 from the forward position of FIG. 6 to the position of FIG. 5, enabling the associated timing mechanism to begin its valve open pumping timing cycle with camming plate 75 rotating in the opposite or counterclockwise direction. Lug 88 actuates valve stem 89 upon completion of the timing cycle moving the valve to an open position for subsequent operation of piston 63 when the pressure differential on the pistons reaches the predetermined level to initiate another well pumping operation.

If desired, timing piston control valve 58 could be entirely eliminated from the control system by various types of mechanisms whereby piston rod 67 will return to its retracted position after actuation of camming plate 75, such as by a slide-trigger-camming arrangement (not shown) which could be mounted at the end of piston rod 67.

Third Embodiment

Figure 8:
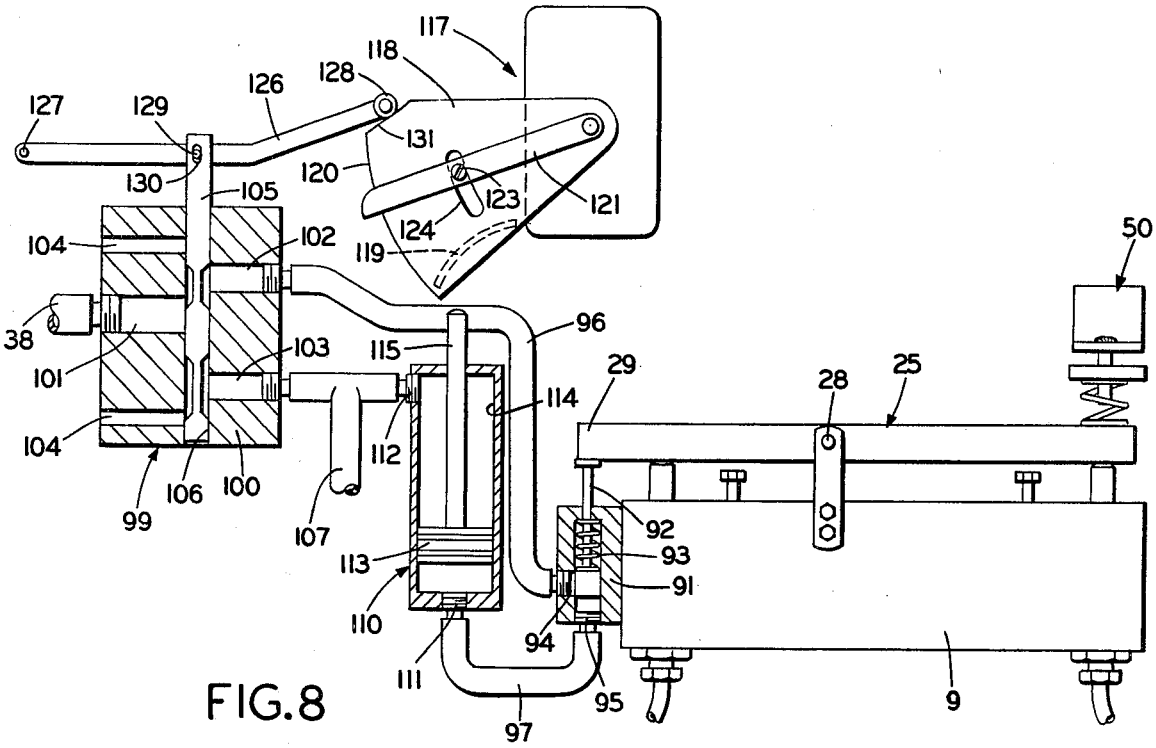
FIG. 8 is a fragmentary generally diagrammatic view, portions of which are in section, showing another modified well pumping control system with the components being in a well "off" position.
Figure 9:
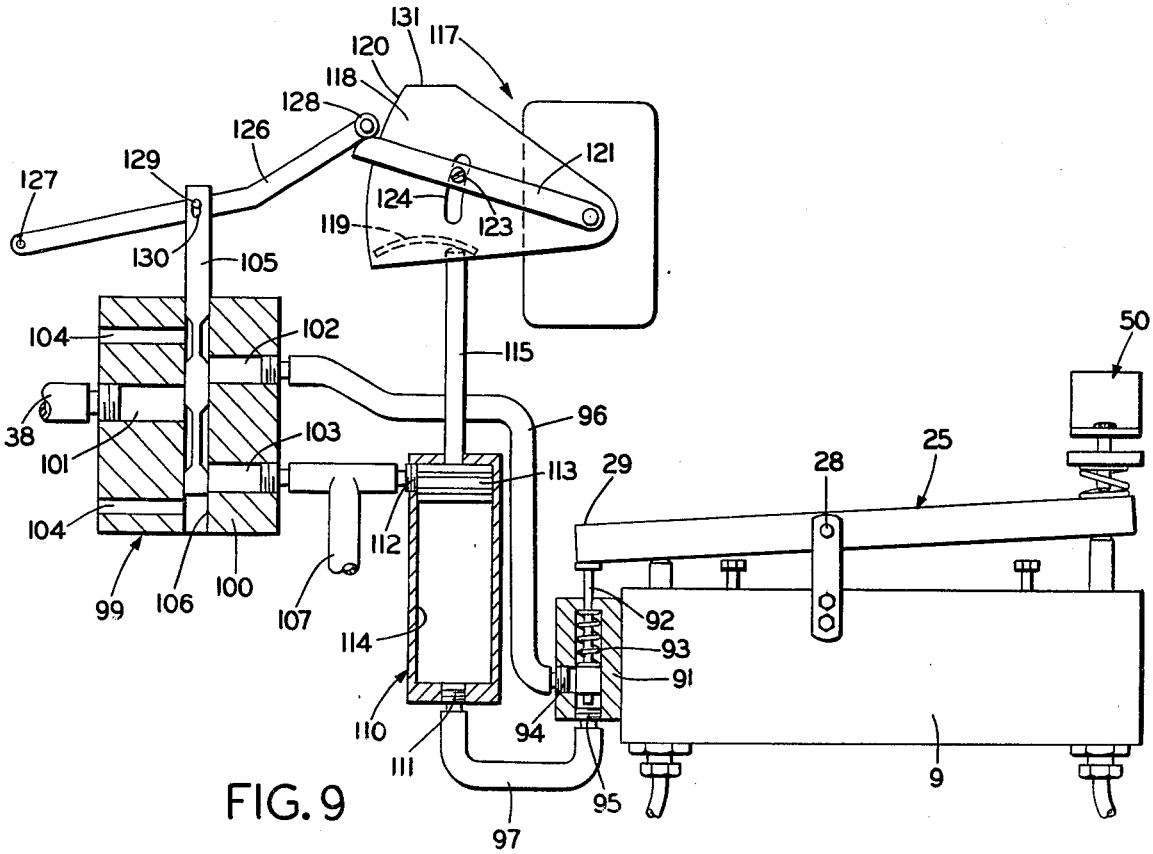
FIG. 9 is a view similar to FIG. 8 with the components being in a well "on" position.

Another modified form of the improved pump control system and beam mechanism is shown in FIGS. 8 and 9. FIG. 8 shows the various components of the system in a well "off" position with FIG. 9 showing the same components in a well "on" position. In this modified system a usual two-way pressure control valve 91 is mounted on the end of pivot block 9 and includes a control plunger 92 which is located beneath and is adapted to be engaged by beam end 29. Plunger 92 is biased by a spring 93 to the closed position of FIG. 8. Valve 91 has a pressure inlet port 94 and an outlet port 95 with pressure lines 96 and 97 connected thereto.

A usual four-way pressure control valve, indicated generally at 99, is mounted on backing board 8 and includes a valve body 100 in which is formed an inlet port 101 and a pair of outlet ports 102 and 103. A pair of usual exhaust ports 104 also are formed in valve body 100. A slidably movable control rod 105 is mounted within a vertical bore 106 for selectively opening and closing outlet ports 102 and 103 with respect to inlet port 101. Pressure line 96 extends between outlet port 102 of valve 99 and inlet port 94 of valve 91 with pressure line 97 extending between outlet port 103 of valve 99 and outlet port 95 of valve 91. A branch pressure line 107 extends between pressure line 97 and delivery tube control valve 4, similar to pressure line 41 in the embodiments shown in FIGS. 1 and 5.

A usual pressure-operated piston assembly 110 is connected in pressure line 97, having an inlet port 111 and an outlet port 112. A piston 113 is vertically, slidably mounted within chamber 114 with a piston rod 115 adapted to move reciprocally, vertically through an opening formed in the top of chamber 114. Piston 113 will move by gravity to the bottom of chamber 114 until sufficient pressure is supplied thereto through inlet port 111 to move piston 113 upwardly within the chamber.

A mechanical timer mechanism 117, similar to mechanism 70, is mounted above piston assembly 110 and has a pivotally mounted camming plate 118. A lug 119 is mounted on plate 118 and is adapted to be engaged by the extended end of piston rod 115 for rotating plate 118 in a clockwise direction for setting timer mechanism 117. A timer adjustment arm 121 is movably mounted on plate 118 by means of a bolt 123, located within an arcuate slot 124.

A link arm 126 is pivotally mounted by pin 127 on backing board 8 above valve 99, and includes a cam follower roller 128 mounted on the extended end thereof. The upper end of valve control rod 105 is connected to link arm 126 intermediate the ends thereof by a pin 129 which is slidably located within a slot 130 formed in the control rod end.

The operation of this modified well pumping control system and components thereof is as follows. Beam 25 will pivot in a counterclockwise direction about pivot pin 28 upon the predetermined pressure differential being reached between the well casing and delivery tube as described above. Beam end 29 actuates control plunger 92 of valve 91 and moves the valve from a closed to open position. The control pressure from gas line 38 passes through control valve 99 due to the position of control rod 105 as shown in FIG. 8, through outlet port 102, pressure line 96 and through opened valve 91 into piston chamber 114. Piston rod 115 moves upwardly and engages lug 119 on timer plate 118, pivotally moving plate 118 in a clockwise direction from the position of FIG. 8 to FIG. 9. This movement of plate 118 mechanically sets the timer for a predetermined timing period.

This upward pivotal movement of plate 118 causes link arm 126 to pivot in an upward counterclockwise direction through the engagement of roller 128 with camming edge 120 of plate 118. This movement of arm 126 in turn raises control rod 105 vertically within valve body 100 from the position of FIG. 8 to that of FIG. 9. This upward movement of slide rod 105 closes outlet port 102 and opens outlet port 103. The loss of pressure in line 96 returns piston 113 to its lower deactuated position, and the pressure through outlet port 103 energizes delivery tube control valve 4 through line 107 to start the well pumping operation.

Camming plate 118 then will begin to rotate downwardly in a counterclockwise direction for the preset time period. Upon completion of this time period, cam follower roller 128 will move beyond arcuate camming edge 120 and onto angle edge section 131, resulting in control rod 105 moving vertically downwardly within bore 106 to the position of FIG. 8. This movement of rod 105 turns control valve 4 to an "off" or nonpumping condition since outlet port 103 is closed by the control rod. This operation is repeated upon the predetermined well pressure differential again being reached as in the other embodiments described above.

SUMMARY

Accordingly, the improved pump control system and beam mechanism enables the pumping action of a well to be initiated immediately upon a predetermined pressure differential existing between the casing pressure and delivery tube pressure regardless of the actual value of the individual pressures. For example, the pressure differential could be adjusted to 50 lbs. by proper adjustment of pivot beam regulating mechanism 50. As the pressure builds up within annular space 81 within well casing 1, for example, to 400 psi, the pressure within delivery tube 2 also will begin to approach this 400 psi level. Upon tube pressure reaching 350 psi, beam 25 will pivot, opening delivery tube control valve 4 and setting timer mechanism 70 for a predetermined valve open or pumping cycle. The length of the pumping cycle set by the action of piston assembly 63 on timer mechanism 70 can be adjusted based upon the particular experience with an individual well. This time period can be set by various adjustment mechanisms in the particular timer used, the particular construction of which forms no part of the present invention.

Another advantage of the improved system and control device is the vertical movement and mounting of pistons 12 and 13 within their chambers 10 and 11. Pistons 12 and 13 are moved upwardly within their chambers by the gas pressure entering the bottom of the chambers through lines 20 and 21 and are lowered entirely by gravity upon a decrease in the actuating pressure. This construction eliminates any springs or other positive return mechanism which is subject to wear, breakage and maintenance problems. Thus, repeated operation of beam 25 by pistons 12 and 13 will result in minimum wear to the pistons.

In many well applications, timer mechanism 70 may be eliminated together with timer actuating piston 63 and associated gas lines 61 and 62, control valve 58, and link arm 46. With this arrangement, beam 25 will open valve 34 through link arm 47 or similar actuating mechanism, which in turn opens delivery pipe valve 4. The pumping action will continue only until the well casing pressure is sufficiently greater than the tube pressure causing beam 25 to pivot in a clockwise direction, returning valve 34 to a closed position. Thus, the "pump on" condition may exist for only several minutes before this pressure differential increases whereby beam 25 closes valve 34, but may be actuated again within several minutes due to the pressure differential, again, approaching the "turn-on" amount.

Accordingly, the improved well control system and mechanisms used therefor provide an extremely simple and inexpensive construction for controlling automatically the operation of a gas well by utilizing the well pressure for the actuating control eliminating any electrical components requiring a source of power, and which system and the components therefor are sturdy and durable in use, which achieve the stated objectives, and which eliminate difficulties encountered with prior control devices.

In the foregoing description certain terms have been used for brevity, clearness and understanding, but no unnecessary limitations are to be implied therefrom beyond the requirements of the prior art, because such words are used for descriptive purposes herein and are intended to be broadly construed.

Moreover, the embodiment of the improved construction illustrated and described herein is by way of example, and the scope of the present invention is not limited to the exact details of the construction shown or described.

Having now described the features, discoveries and principles of the invention, the manner in which the well pumping control system is constructed, assembled and operated, the characteristics of the new construction, and the advantageous, new and useful results obtained; the new and useful structures, devices, elements, arrangements, parts, and combinations are set forth in the appended claims.

I claim:

1. A system for automatically operating a fluid delivery control valve in a gas well including:

(a) beam means pivotally mounted for movement between actuating and deactuating positions;

(b) first piston means operatively engageable with the beam means for moving said beam means between the actuating and deactuating positions, said first piston means being operatively connected to the well and operated by and in relationship to pressures developed within the well;

(c) first valve means movable between open and closed positions by the beam means, the first valve means being adapted to be operatively connected to the fluid delivery control valve for operating said control valve in response to operation of said first valve means by the beam means;

(d) timer means;

(e) link means operatively engageable with the timer means, with the first valve means, and with the beam means, said link means being actuated by the beam means for controlling said timer means;

(f) second piston means operatively engageable with the timer means and actuating the timer means when the beam means moves from deactuating to actuating positions; and (g) the link means deactuating the timer means and permitting the first valve means to move to closed position after a predetermined time period, whereupon the fluid delivery control valve is deactuated by the first valve means upon closing of the first valve means to stop the flow of fluid from the well.

2. The system defined in claim 1 in which the beam means has first and second ends; in which pivot means is operatively engaged with the beam means intermediate the first and second ends; and in which the first end is operatively engaged with the first valve means.

3. The system defined in claim 2 in which the first piston means includes first and second pistons operatively engageable with the beam means first and second ends, respectively; in which the first and second pistons are operatively controlled, each by a different pressure developed within the well; in which the pressure controlling the first piston is always equal to or greater than the pressure controlling the second piston; and in which the second piston pivots the beam means from deactuating to actuating positions when the difference in the pressures controlling the first and second pistons reaches a predetermined amount.

4. The system defined in claim 3 in which adjustable spring means is operatively engaged with the second end of the beam means for adjusting the amount of difference required between the pressure controlling the first and second pistons for pivotal movement of the beam means from deactuating to actuating positions.

5. The system defined in claim 3 in which the beam means has a shorter moment arm with respect to the first piston than does the second moment arm with respect to the second piston.

6. The system defined in claim 1 in which the timer means includes a rotatably mounted camming plate and biasing means; and in which the biasing means is actuated upon rotation of the camming plate in one direction to bias the camming plate toward rotation in the opposite direction.

7. The system defined in claim 6 in which the second piston means rotates the timer means camming plate in the said one direction a predetermined arcuate distance.

8. The system defined in claim 7 in which the link means is engaged with the camming plate of the timer means; in which stop means is provided on the camming plate and is engaged by the link means to limit the amount of rotation of the timer means in said opposite direction; and in which the link means moves the first valve means from open to closed position upon engagement of said link means with the camming plate stop means.

9. The system defined in claim 8 in which the link means is rotatably mounted on the first valve means and includes first and second ends; in which the first end is operatively engaged by the beam means for rotation of said link means upon pivotal movement of the beam means from deactuating to actuating positions; and in which the second end of the link means is operatively engageable with the camming plate of the timer means.

10. The system defined in claim 9 in which the camming plate stop means includes a notch formed in the outer periphery of said camming plate; in which the link means second end has pin means which is operatively engageable within the camming plate notch to prevent further rotation of the camming plate after a predetermined amount of rotation of said camming plate in said opposite direction.

11. The system defined in claim 10 in which the second end pin means of the link means is disengaged from the stop means notch of the timer means camming plate upon pivotal movement of the link means by the beam means from deactuating to actuating positions.

12. The system defined in claim 1 in which a first fluid pressure line is connected to the first valve means; in which a second fluid pressure line extends from the valve means and is adapted to be connected to the fluid delivery control valve for actuation of said control valve upon movement of the first valve means to open position; and in which a third fluid pressure line is connected to the second piston means for actuation of said second piston means.

13. The system defined in claim 12 in which second valve means is mounted in the third fluid pressure line; and in which said second valve means is operatively engaged with and operated by the beam means.

14. A control device for use with a gas well of the type having an outer casing and an inner delivery tube, for automatically opening a control valve which is operatively connected to the delivery tube for pumping of fluids collected within the well through the delivery tube including:

(a) beam means having first and second ends;
(b) pivot means engaged with the beam means intermediate the first and second ends pivotally mounting said beam means for movement between valve actuating and deactuating positions;
(c) first and second piston means operatively engaged with the first and second ends of the beam means, respectively, for pivoting said beam means between the valve actuating and deactuating positions;
(d) a first pressure line extending between and communicating with the well casing and first piston means;
(e) a second pressure line extending between and communicating with the well delivery tube and second piston means;
(f) first valve means operatively engageable with the first end of the beam means and movable between open and closed positions by the beam means;
(g) a third pressure line extending between the first valve means and the delivery tube control valve; and
(h) the first piston means maintaining the beam means in the valve deactuating position until a predetermined pressure difference exists between the outer well casing and delivery tube, whereupon the second piston means overcomes the force exerted on the beam means by the first piston means and pivots the beam means from valve deactuating to valve actuating position and opens the first valve means which in turn opens the delivery tube control valve.

15. The device defined in claim 14 in which the length of the moment arm extending between the pivot means and point of engagement with the first piston means is less than the length of the moment arm extending between the pivot means and point of engagement with the second piston means.

16. The device defined in claim 14 in which timer means is operatively connected to the beam means; and in which the timer means maintains the first valve means in open position for a predetermined period of time after opening of said first valve means by the beam means.

17. The device defined in claim 16 in which the timer means includes a mechanical actuated timer, third piston means adapted to set said timer for a predetermined time period, and link means adapted to stop said timer after termination of said time period.

18. The device defined in claim 17 in which second valve means controls actuation of the third piston means; and in which the second end of the beam means is engaged with the second valve means for operating said second valve means.

19. The device defined in claim 17 in which second valve means controls actuation of the third piston means; in which trip means is mounted on the timer; and in which the timer trip means engages the second valve means for operating said second valve means.

20. The device defined in claim 17 in which the link means is operatively engaged with the first valve means, with the beam means and with the timer; and in which pivotal movement of the beam means from deactuating to actuating positions pivots the link means out of stopping engagement with the timer, and simultaneously moves the first valve means to open position.

21. The device defined in claim 14 in which adjusting means is operatively engaged with the beam means to adjust the amount of pressure differential required to pivot the beam means to valve actuating position.

22. The device defined in claim 21 in which the adjusting means includes an adjustable spring engaged with the second end of the beam means biasing the beam means toward valve deactuating position.

23. The device defined in claim 14 in which the beam means includes a mounting block; in which the pivot means includes an upstanding bracket mounted on the mounting block with the beam means being mounted on said bracket spaced above the mounting block and in a generally horizontal position; in which first and second vertically extending spaced piston chambers are formed in the block and are located below the first and second ends of the beam means, respectively; and in which the first and second piston means are slidably mounted in a respective piston chamber for vertical movement therein and are adapted to engage a respective end of the beam means.

24. The device defined in claim 23 in which the first and second pressure lines communicate with the first and second piston chambers, respectively, adjacent the bottoms thereof and below the piston means; and in which the fluid pressure from the pressure lines raise the piston means, and in which the piston means are lowered by gravity.

25. The device defined in claim 23 in which the second piston chamber has a larger volume than does the first piston chamber.

26. A control system for a well of the type having an outer casing and an inner delivery tube, for automatically opening a control valve which is operatively connected to the delivery tube for pumping of fluids collected within the well through the delivery tube including:

(a) pivotally mounted beam means;

(b) a first valve actuated by pivotal movement of the beam means;

(c) first piston means operatively engageable with the beam means for pivoting said beam means to actuate the first valve;

(d) a mechanical timer;

(e) a second valve operatively connected to the timer and to the delivery tube control valve for opening said control valve in response to actuation of the first valve by the beam means;

(f) means communicating with the well casing and delivery tube and with the first piston means for actuating said first piston means upon the pressure differential between the well casing and delivery tube reaching a predetermined amount to pivot the beam means and actuate the first valve, and in turn actuate the second valve to open the delivery tube control valve; and (g) second piston means operatively engaged with the timer for setting said timer for a predetermined time period upon actuation of the first valve by the beam means, with said timer deactuating the second valve after passage of said predetermined time period which closes the delivery tube control valve.

27. The system defined in claim 26 in which link means operatively couple together the second valve with the timer means; and in which the link means deactuates the second valve after passage of the predetermined time period.

28. The system defined in claim 27 in which the second valve has an inlet which is connected to a control pressure supply, and a pair of outlets, with an internal slide rod alternately connecting said outlets with the inlet; in which one of the outlets communicates with the second piston means with the other of said outlets communicating with the delivery tube control valve; and in which the slide rod is operatively connected to the link means.

* * * * *